US006085910A

United States Patent [19]

Holmes

[11] Patent Number: 6,085,910

[45] Date of Patent: Jul. 11, 2000

[54] COIN PACKAGING SYSTEM

[75] Inventor: Gordon W. Holmes, Mississauga, Canada

[73] Assignee: Coin Logic Inc., Aurora, Canada

[21] Appl. No.: 08/898,009

[22] Filed: Jul. 25, 1997

Related U.S. Application Data

[60] Provisional application No. 60/024,273, Aug. 21, 1996.

[51] Int. Cl.[7] ..... A45C 1/00

[52] U.S. Cl. ..... 206/830; 206/840; 206/445; 206/506; 206/511

[58] Field of Search ..... 206/81–84, 564, 206/445, 506, 511, 519, 520

[56] References Cited

U.S. PATENT DOCUMENTS

| | | | |
|---|---|---|---|
| Re. 31,264 | 6/1983 | Holmes | 206/82 |
| 1,795,967 | 3/1931 | Read . | |
| 2,909,280 | 10/1959 | Furno et al. | 206/82 |
| 4,095,608 | 6/1978 | Holmes | 206/82 |
| 4,139,093 | 2/1979 | Homes | 206/82 |
| 4,239,051 | 12/1980 | Holmes . | |
| 4,541,528 | 9/1985 | Holmes | 206/83 |
| 4,715,492 | 12/1987 | Holmes | 206/83 |
| 5,445,397 | 8/1995 | Evans | 206/519 |
| 5,752,602 | 5/1998 | Ackermann et al. | 206/507 |

FOREIGN PATENT DOCUMENTS

| | | |
|---|---|---|
| 630077 | 7/1963 | France . |
| 2090032 | 1/1972 | France . |
| 1138137 | 12/1968 | Germany . |
| 279784 | 12/1951 | Switzerland . |

*Primary Examiner*—Paul T. Sewell
*Assistant Examiner*—Nhan T. Lam
*Attorney, Agent, or Firm*—Sim & McBurney

[57] ABSTRACT

An integrally-formed coin holder formed of plastic material has a generally V-shaped structure, in end view, and resiliently flexible arms to permit coins to be packaged in and removed from the coin holders. The coin holder has a series of open pockets, which provide a multiple-point support for the coins in the holder and a perfect coin count every time.

10 Claims, 7 Drawing Sheets

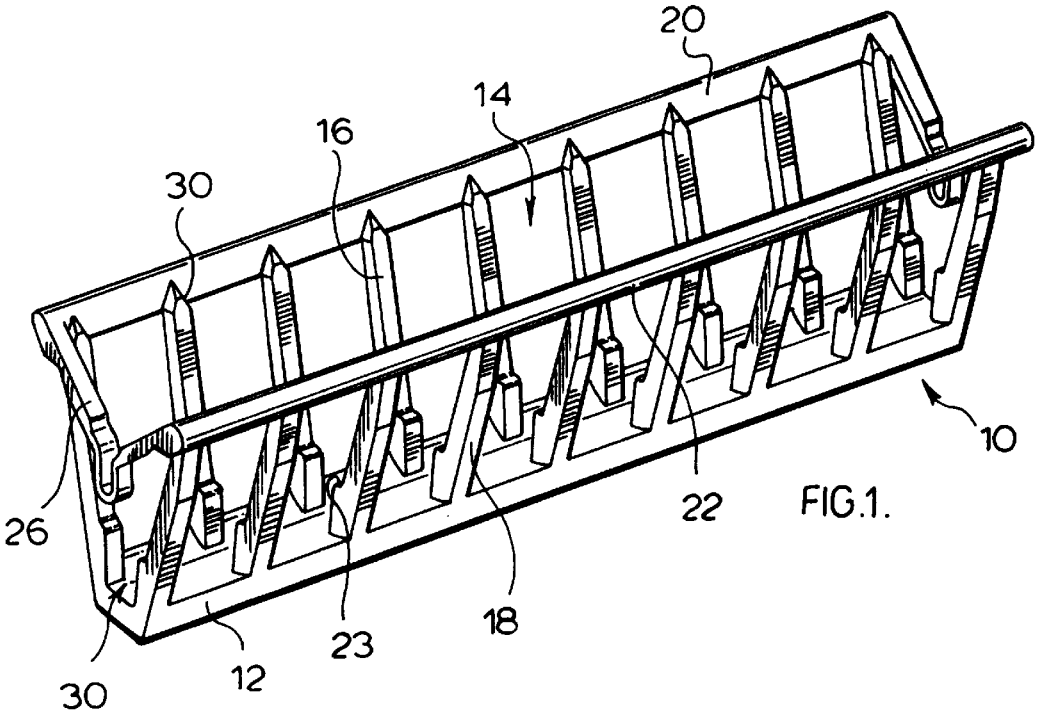
FIG.1.
FIG.2.
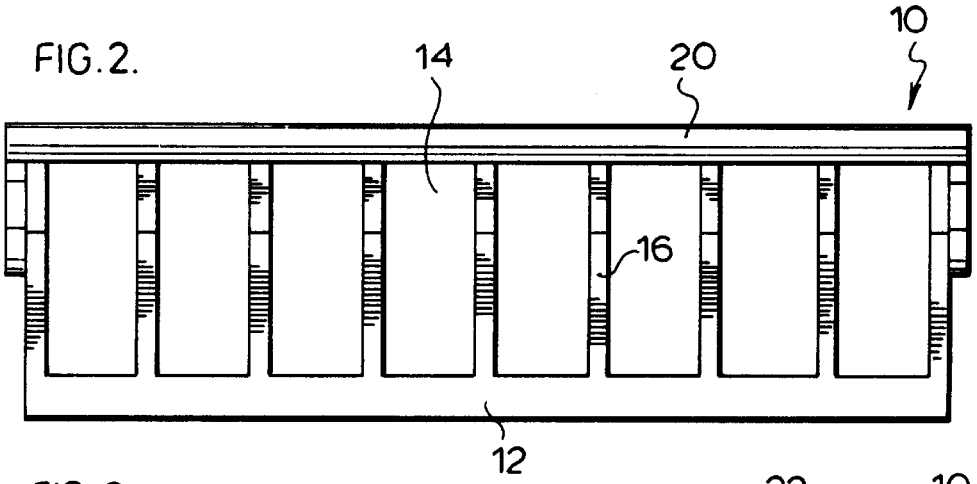
FIG.3.
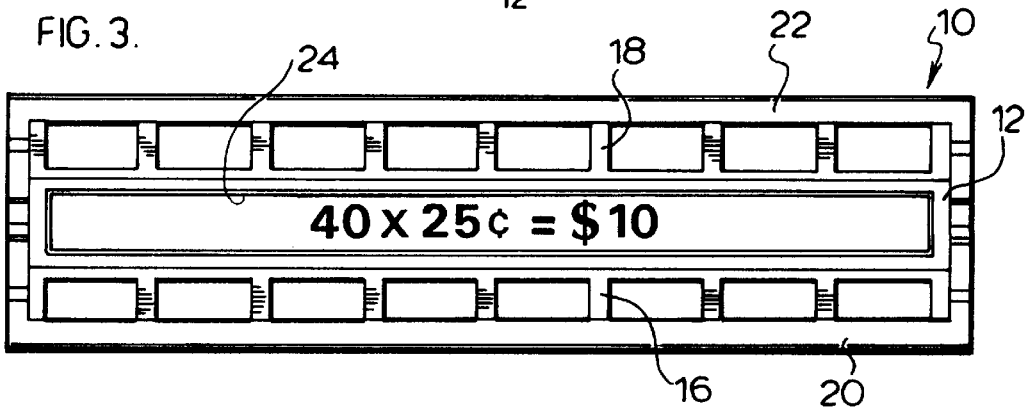

COIN PACKAGING SYSTEM

This application claims benefit of provisional application 60/024,273, filed Aug. 21, 1996.

FIELD OF INVENTION

The present invention is concerned with a novel coin packaging system.

BACKGROUND TO THE INVENTION

There are a number of existing methods of coin packaging which include:

Paper Wrapping

Plastic Pouches

Shrink Wrapping

Hinged/Thermoformed Clip

Injection Moulded Clips

This section outlines the benefits and problems associated with each of the above mentioned coin packaging methods.

Paper Wrapping

Paper wrapping of coin has been around for a long time, probably at least 75 years. Shop keepers and business people may have hand wrapped coin of similar denominations long before that. Machine wrapping of coins in the traditional kraft paper wrap had its beginning in Germany approximately seventy-five years ago.

Advantages

Low cost

Existing technology

Most accepted form of packaging

Disadvantages

Opaque packaging method which hides the contents of the package, and is prone to various forms of fraud.

Actual count of coins in the roll is difficult to determine without opening roll and counting contents. The integrity of the coin count depends on the person or machine wrapping the coins.

Wrapper is used once and then discarded, (i.e.) non-reuseable

The machine wrapping of coins is slow, at 25 to 35 rolls per minute, and prone to maintenance problems.

Wrappers are made of brown kraft paper and rolls of various denominations are difficult to distinguish.

Paper wrappers can be difficult to open, and in some cases, individual coins may be inadvertently discarded with the scrap wrapper.

Clear Plastic Pouches

This form of packaging is used in many countries in the world. The pouches are small plastic bags with "Zip Lock" type seals. The coins are manually or semi-automatically loaded into these pouches.

Advantages low cost visual packaging easily dischargeable recycleable

Disadvantages

The number of coins in a pouch can only be determined by removing and counting them. This is extremely time consuming for retail and institutional clerks and front line personnel, but necessary to ensure proper till balances.

The zippers on the pouches have a difficult time remaining closed if carrying large size or heavy amounts of coins.

Filling of the pouches is normally done semi-automatically, whereby the teller holds the pouches under a chute, and closes the bag manually after being filled. This also allows another element of human error.

This system is not designed for high speed filling automation.

Plastic Tubular Film Wrap

This form of packaging involves overwrapping a specified amount of coins with a clear tubular plastic film which is heated to shrink wrap the coins in a tight bundle. This is an accepted method of coin packaging and second in preference to the paper wrap.

Advantages low cost visible packaging up to 100 rolls per minute in packaging line speed Disadvantages The film must be very tough in order to be effective, but staff at the front line of retail outlets often have difficulty removing coins, with broken nails and coins falling all over the floor as a result.

The actual amount of coins in the tube can only be determined by actually counting the coins upon removal.

Molded Plastic Coin Holders

In all instances, molded plastic coin holders have been developed as consumer products, either sold in stores or distributed by banks to facilitate return of coinage to banking institutions, primarily by consumers. Instead of laboriously hand wrapping coins in paper wrappers, which requires manual counting of the coins beforehand, the plastic coin holders of various design concepts make the job easier and faster, as described further below:

(a) Thermoformed Clamshells

This form of packaging is also an accepted method of coin packaging, and is normally sold in retail stores and hand loaded by consumers.

Advantages low cost limited recyclablity visual packaging

Disadvantages

This product is made of thin thermoformed PETG and the clamshell hinge and locking concepts are not designed for repeated use. Some reuse is possible.

Coin cavity does not have crisp defined boundaries, and is not rigid. Number of coins fitting the cavity can vary depending on how it is loaded, and because of its flexibility!

Coins must be counted to actually determine quantity in each clip.

This system is not designed for high speed packaging.

The closure usually works on a dome fastener principle, or snap lock feature and the male and female domes or grooves, in the light film, become crushed or damaged.

Light film is subject to tearing, ripping, splitting as well as distortion.

Rather expensive to buy at retail for single use.

(b) Injection Molded Clips

The inventor herein has previously patented two types of injection molded clips. These designs have considerable advantages over the coin packaging system already described, but do not represent ideal systems, as discussed below.

The first clip, described in U.S. Pat. No. 4,139,093, is a single cell clip of very strong and durable design that unfortunately, because of its single cell structure, cannot provide a perfect coin count every time.

The other weakness of the single cell structure described in this patent is that no one, including a bank teller, can tell at a glance whether the correct number of coins is contained in the clip or if one or two might be missing (even if it has the correct number).

This single cell design may often hold two or three additional coins without being detected.

The second clip, described in U.S. Pat. No. 4,541,528, solved all the problems for the consumer and provides a clip divided into segments or pockets which each holds five coins by using a series of thin dividers in the bottom half of a fold-over clip concept with automatic locking means for the cover.

Based on this concept, when the clip is full it contains a perfect coin count every time. By taking care of the problem of coin variation, all counting by the consumer or teller prior to packaging, is eliminated. A person can see at a glance if one of the five coins in any pocket of the clip is missing. Tellers and cashiers can also use the divided clip to accurately count and wrap cash at the end of each shift (in the bank or retail store).

In short, this patented concept meets the need for fast and convenient manual packaging of coin, with instant visual verification of denomination and count accuracy.

Four weaknesses, however, remain:

a) The bulkiness of the design with a hinged lid structure means increased cost of material.

b) The fact that it is non-stackable means higher costs for shipping and storage as well as excessive space requirements in bank branches.

c) The design is not intended for high-speed automated filling.

d) Because of the design and heavy structure the manufacturing cycle time is slow and the price is considerably higher.

A unique opportunity, therefore, still exists for a coin holder structure which overcomes all the prior art problems which are recounted above. It will be seen in the sections which follow how the present invention meets all of the above problems and disadvantages and makes available, for the first time, an automated, high speed, secure system of coin packaging that sets a new standard in the industry. There are clear and significant advantages of the novel coin packaging system provided herein for banking institutions, retail stores and other major coin users, and everyone down the line to the ultimate consumer.

OBJECTS AND SUMMARY OF INVENTION

One of the major objects of this invention is the provision of a package, expressed more correctly as a "complete system", that overcomes all the problems of the prior art discussed above. As the many objects and features of this invention are discussed, it will become apparent how previous shortcomings have been overcome and how many new and useful features make this invention of significantly improved utility and convenience.

From the very outset, one of the clear objectives of this invention was the development of a high speed coin packaging system using a simplified, low cost, plastic coin holder or clip that preferably would be strong enough to recirculate several times to retailers and consumers alike. In order to make this result achievable and affordable, machine speeds of at least 200 or more filled clips of coin per minute should be attainable in order to more than offset the cost of plastic versus low cost kraft paper. To enhance the filling speed, the clips must be stackable and packaged into cartridges to be loaded into a machine, or manufactured in sheets that may be stacked and sheet fed into a machine. In this way, shipping, handling, storage etc. of the clips are simplified and large cost savings result.

In one embodiment, this new design of clip also stacks inside one another to greatly reduce storage and shipping costs. This, and many other features will be illustrated by referring to the accompanying drawings, which description follows below.

For economic reasons, the clip that holds the coins is designed with a minimum material content yet is structured in such a way as to provide for maximum strength, high output and low cost.

Accordingly, in one aspect of the invention, there is provided an elongate bar element having longitudinal sides, a plurality of pockets each dimensioned to hold a stack of the same predetermined number of coins, each of said pockets being defined by pairs of arm elements extending outwardly one pair from each longitudinal side of the bar element to upper parallel elongate elements parallel to the bar element, the arm elements and the upper bar elements being moveable between a first position wherein the distance between the upper bar elements is less than the diameter of the coins and a second position wherein the distance between the upper bar elements is at least the diameter of the coin to permit the coins to be inserted into or removed from the pockets, and means for resisting insertion or removal of coins into or from the pockets when the upper bar elements are in the first position.

In a preferred embodiment of the invention, there is provided an elongate bar having longitudinal sides, a plurality of pockets each dimensioned to hold a stack of the same predetermined number of coins, each of the pockets being defined by pairs of arm elements extending upwardly and outwardly one pair from each longitudinal side of the bar element to upper parallel elongate rail elements parallel to the bar element, the arm elements and the upper rail elements being resiliently flexible between a first position wherein the distance between the upper rail element is less than the diameter of the coins restraining coins from being inserted into or removed from the pockets and a second position wherein the distance between the upper rail elements is at least the diameter of the coin to permit the coins to be inserted into or removed from the pockets.

BRIEF DESCRIPTION OF DRAWINGS

FIG. 1 is a perspective view of a coin holder provided in accordance with one embodiment of the invention;

FIG. 2 is a side elevational view of the coin holder of FIG. 1;

FIG. 3 is a view from below of the coin holder of FIG. 1;

DESCRIPTION OF PREFERRED EMBODIMENTS

Figure 4A:
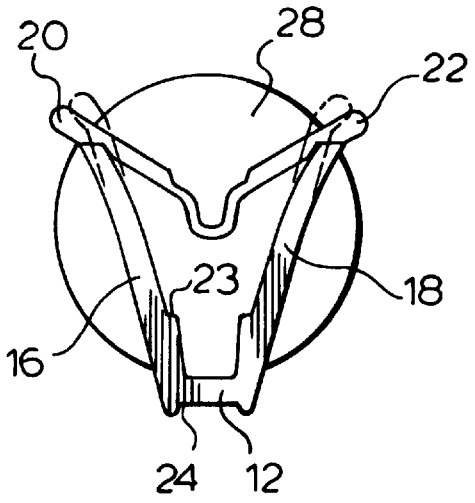
FIGS. 4A and 4B are end views of the coin holder of FIG. 1, showing coin packaged in the coin holder (FIG. 4A) and flexure of the ribs to permit coins to be inserted into and removed from the coin holder (FIG. 4B)
Figure 4B:
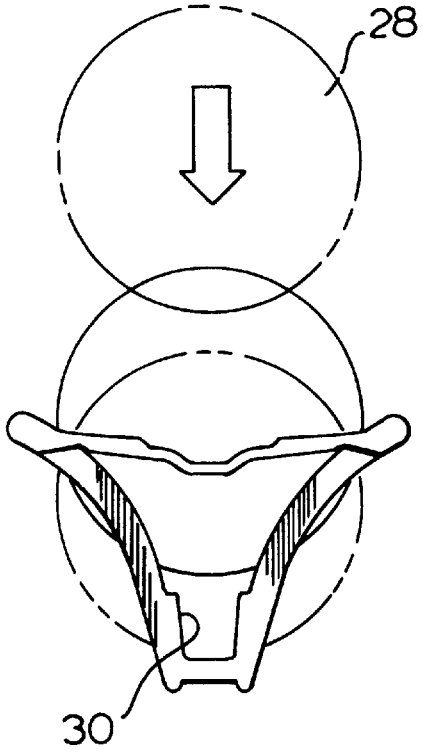

Referring first to FIGS. 1 to 5, there is illustrated therein a coin holder 10 constructed in accordance with one embodiment of the invention. As seen therein, the coin holder 10, which is constructed of plastic material and may be injection molded, comprises an elongate bar 12, which serves as a base for the coin holder 10, and a plurality of pockets 14 into which a stack of a predetermined number of coins, say five, may be inserted or from which the stack of coins may be removed.

The pockets 14 are defined by pairs of arms 16,18 which extend upwardly and outwardly one pair from each longitudinal side of the elongate bar 12 to define a generally V-shaped structure. The pairs of arms 16,18 terminate in upper elongate rail elements 20,22 which are parallel to each other and to the elongate bar 12.

Figure 5:
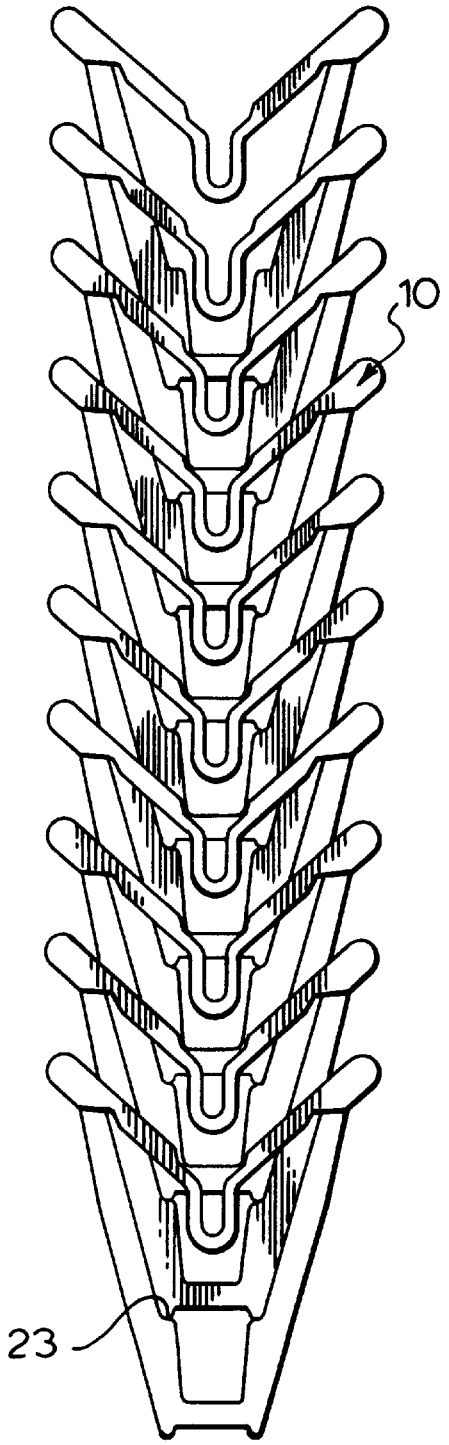
FIG. 5 is an end view of a stack of empty coin holders of FIG. 1.

A plurality of the coin holders 10 may be readily stacked, as seen in FIG. 5, for ease of storage and shipment. The arms 36, 18 have a shoulder 25 which permits the elongate bar 12 to rest in a stack (FIG. 5) of the coin holders 10 in a supported position, to avoid jamming of the coin holders in the stack.

The elongate bar 12 may have a recess 24 to permit embossed or raised text to be provided thereon, such as the identity of the coin and numbers thereof intended to be packaged in the coin holder 10.

At each end of the coin holder 10 is provided a limiting arm 26 joined to the upper elongate rail elements 20, 22 to provide a limit for expansion of the distance between the rail elements 20, 22.

The coin holder 10 is constructed of resiliently-flexible material, which permits a coin or a stack of coins to be placed in, stored in and removed from the coin holder 10. As may be seen specifically in FIGS. 4A and 4B, coins 28 are placed in or removed from the coin holder 10 by inverting the clip and by outward flexing of the upper elongate rail elements 20 and 22 and the arms 16 and 18 until the linear distance between the elongate rail elements 20 and 22 exceeds the diameter of the coin 28, thereby permitting the coin 28 or stack of coins to pass between the upper elongate rail elements 20 and 22.

A stack of a predetermined number of coins, corresponding to the number of coins which can fit in the individual pockets 14, are held in the pockets 14 by engagement at the periphery thereof with the elongate bar 12 and the elongate rail elements 20,22, i.e. a three-point engagement, combined with facial engagement with the arms 16, 18 at the two ends of each stack. The coin holder 10 generally is dimensioned such that the elongate rail elements 20,22 are spread apart greater than their at-rest position when coins are packaged in the pockets 14, so that the coins are gripped under tension while located in the coin holder, as seen in FIG. 4A.

At the upper extremities of the ribs 16, the ribs preferably may be tapered 30 to facilitate as well as guide the coins into the pockets 14. The lower extremities of the arms 16, 18 may be thickened to define a recess 30 having the shoulder 23 for a robotics handling and gripping feature on the two lower ends of the clip. In addition, these thickened extremities and series of notches or shoulders 23 also contribute to ease of stackability without the coin holders becoming jammed together, as discussed above. This feature is also important for high speed feeding and filling.

Figure 6:
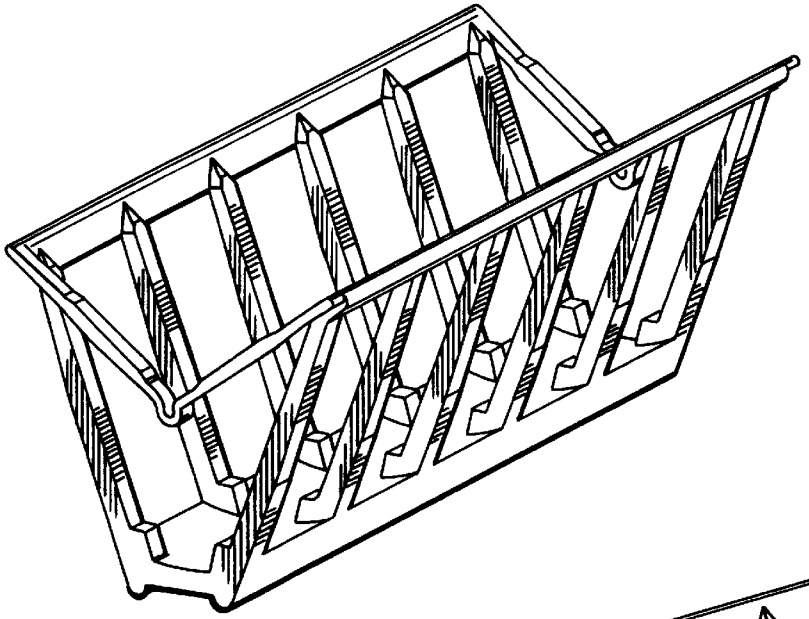
FIGS. 6 and 7 are perspective views of coin holders of the type shown in FIG. 1 but with a different number of pockets.
Figure 7:
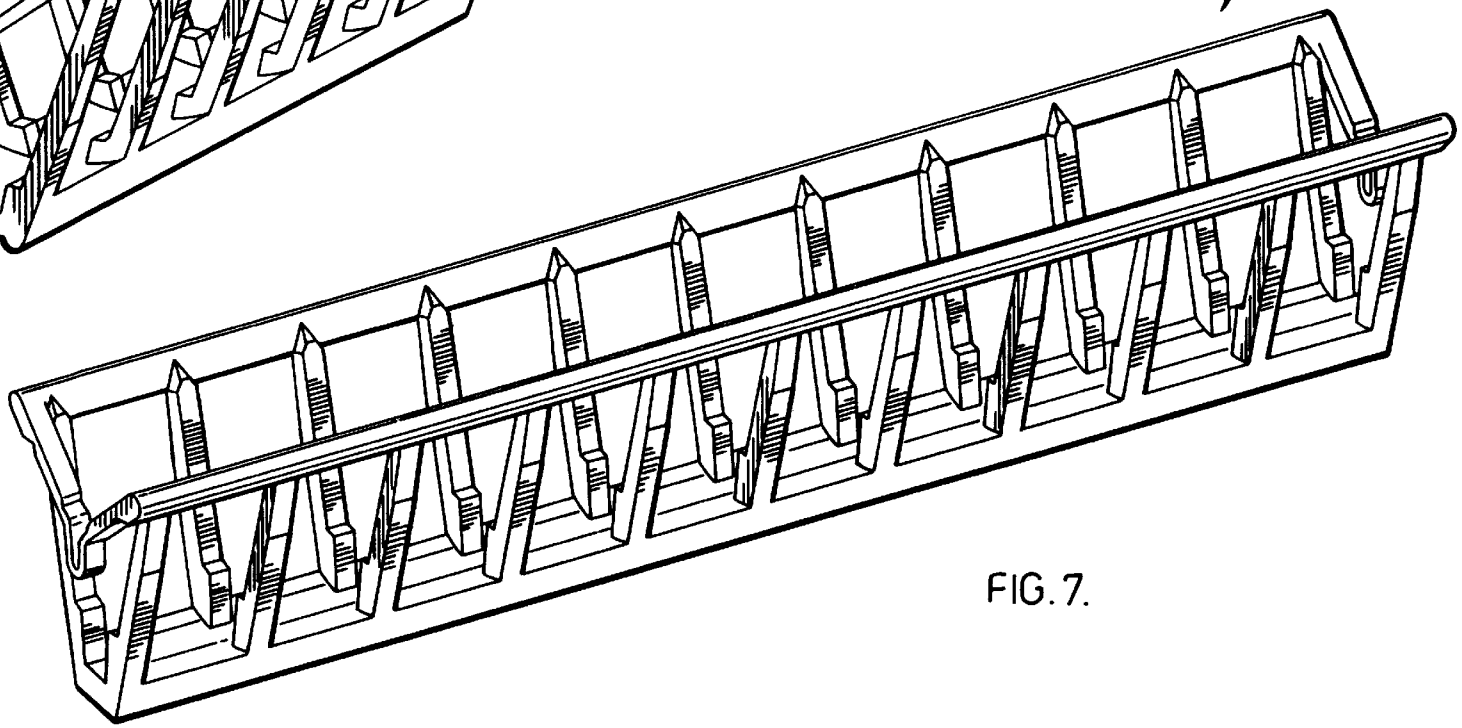

FIGS. 6 and 7 show a similar structure of coin holder 10 to that shown in FIGS. 1 to 5, but configured with a fewer or greater number of pockets 14 to package a lesser or greater total number of coins 28 in the coin holder 10. For example, the FIG. 1 configuration may be used to package 40×25 cent coins in 8 pockets 5 coins each while the FIG. 6 configuration may be used to package 25×$1 coins in 5 pockets of 5 coins each and the FIG. 7 configuration may be used to package 50×1 cent coins in 10 pockets of 5 coins each.

Figure 8A:
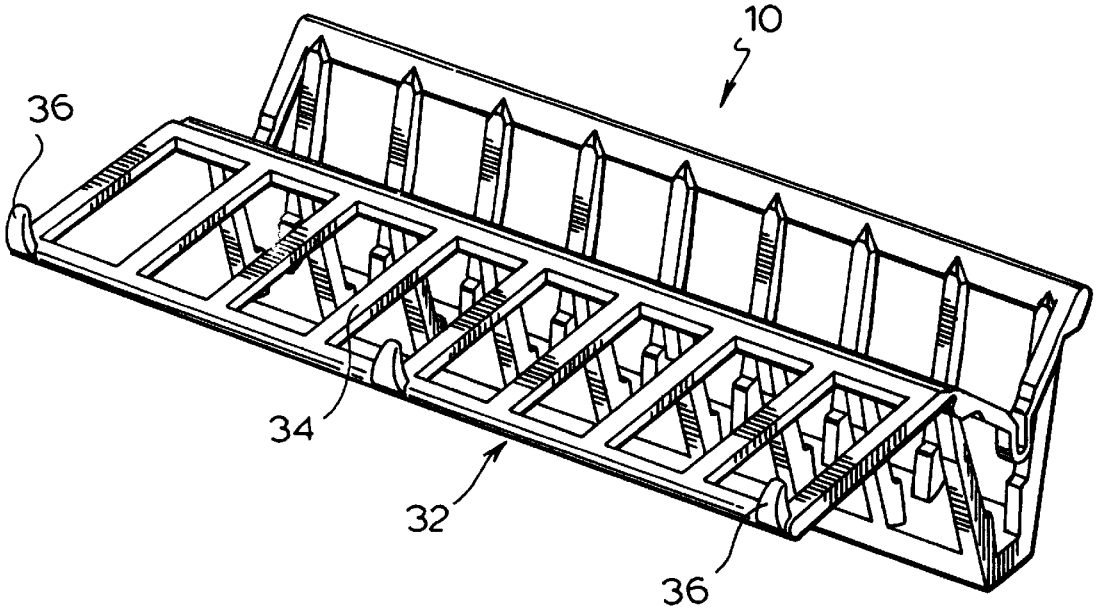
FIGS. 8A and 8B show perspective views of modified forms of the coin holder of FIG. 1.
Figure 8B:
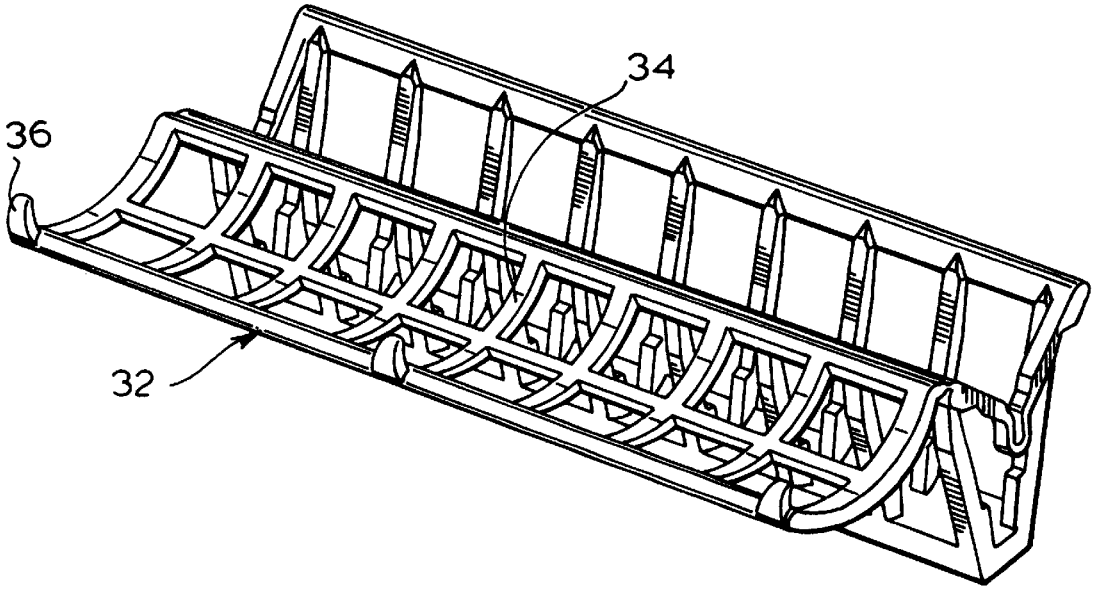

FIGS. 8A and 8B illustrate two alternative designs of coin holder to that shown in FIGS. 1 to 5. While the structure of coin holder 10 illustrated in FIGS. 1 to 5 provides a very secure packaging of the coins, an upper closure element 32 may be provided hinged to one of the upper elongate rail elements 20,22. The upper closure element 32 may include ribs 34 corresponding to ribs 16, 18 and further may include locking tabs 36 to permit the closure to be secured.

Figure 9A:
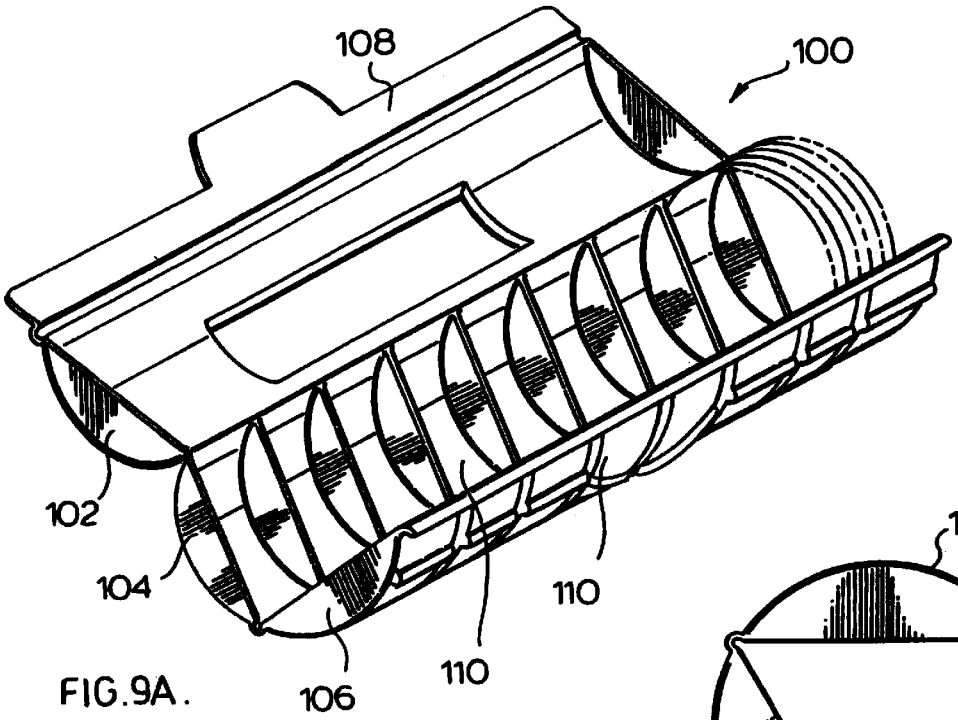
FIGS. 9A , 9B and 9C show perspective, plan and end views of a coin holder provided in accordance with another embodiment of the invention.
Figure 9C:
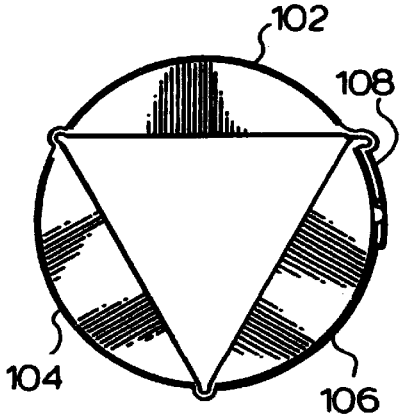
Figure 9B:
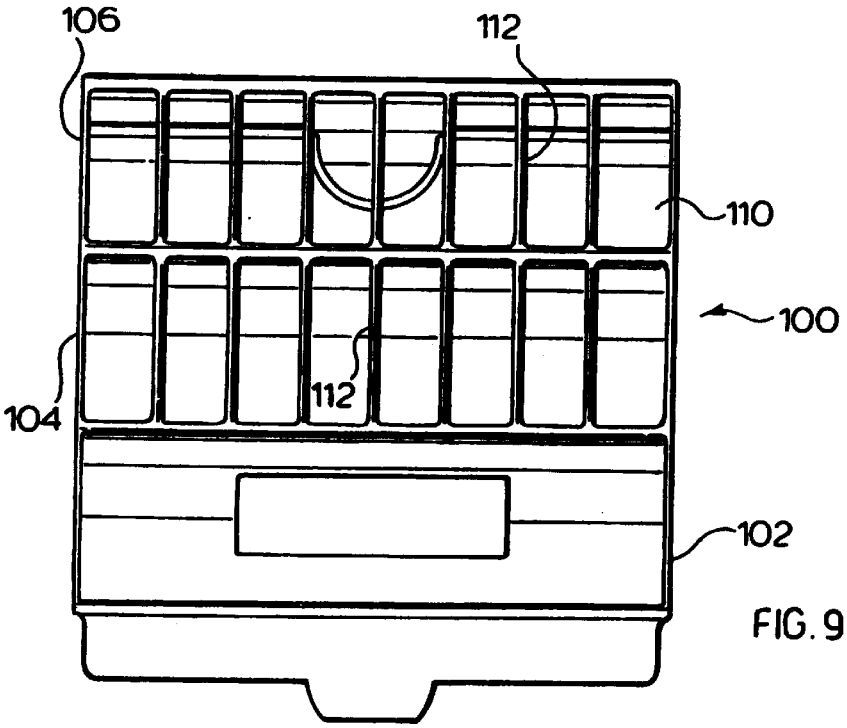

FIGS. 9A, 9B and 9C illustrate a modified form of the coin holder 100 of FIGS. 1 to 5, which is intended to be thermoformed as three integral elements 102, 104, 106, which are hinged to each other to be wrapped around the coins and locked in place by a lid element 108. Pockets 110 for coin retention are defined by a plurality of ribs 112 formed in elements 104, 106.

Figure 10A:
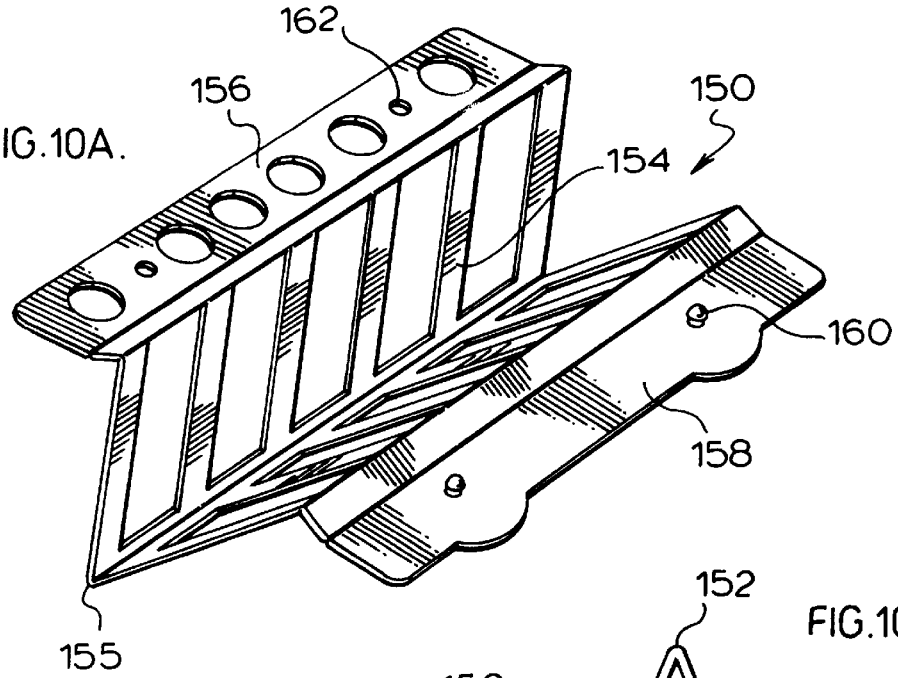
FIGS. 10A, 10B and 10C are perspective views of a coin holder provided in accordance with a further embodiment of the invention, shown in the open (FIG. 10A), plan (FIG. 10B) and closed (FIG. 10C) positions.
Figure 10C:
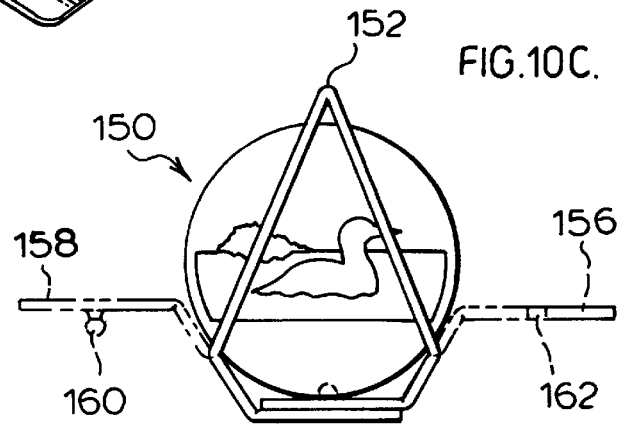
Figure 10B:
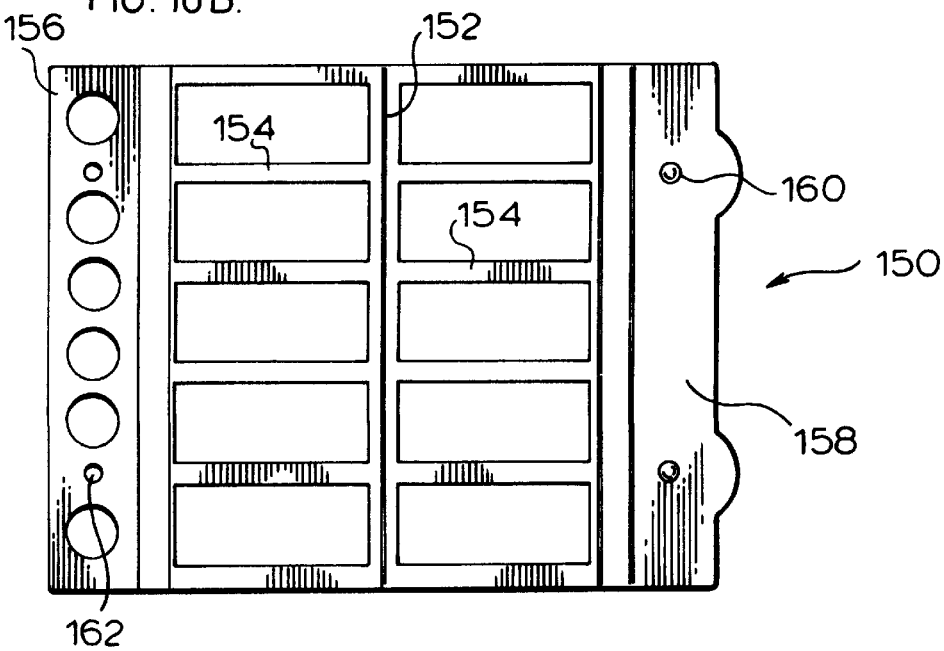

FIGS. 10A, 10B and 10C show a further alternative form of the coin holder 150. In this instance, the elongate bar is replaced by a hinge element 152 and the upper extremities of the arm elements 154 terminate in planar elements 156, 158 hinged thereto and which are provided with interlocking elements 160, 162, which permits the coin holder 150 to be closed and opened and to secure the coins therein. The interlocked planar elements 156, 158 may conveniently provide a planar surface to support the holder, as seen in FIG. 10C.

Figure 11B:
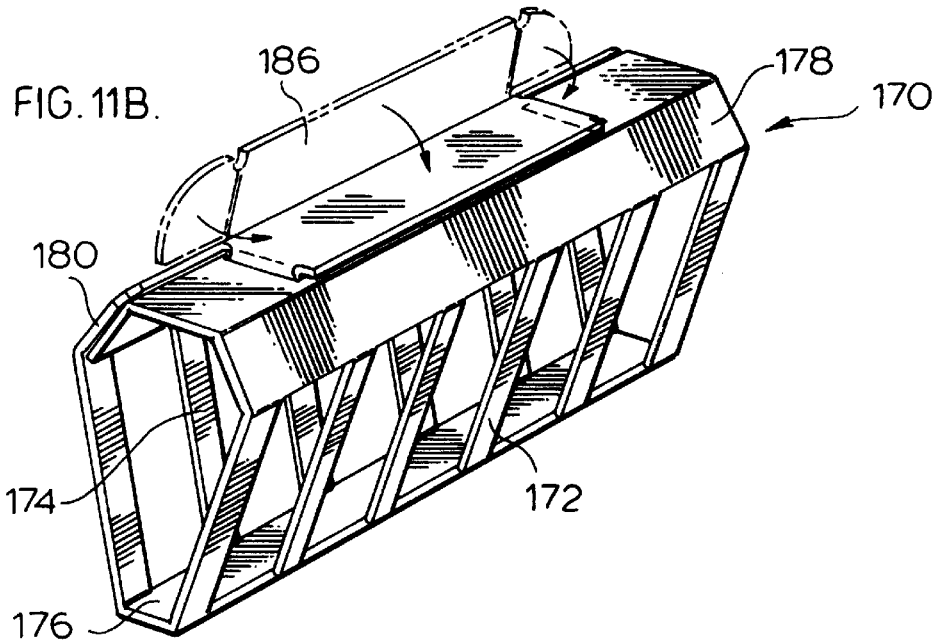
FIGS. 11A and 11B are plan and perspective views of a coin holder provided in accordance with an additional embodiment of the invention.
Figure 11A:
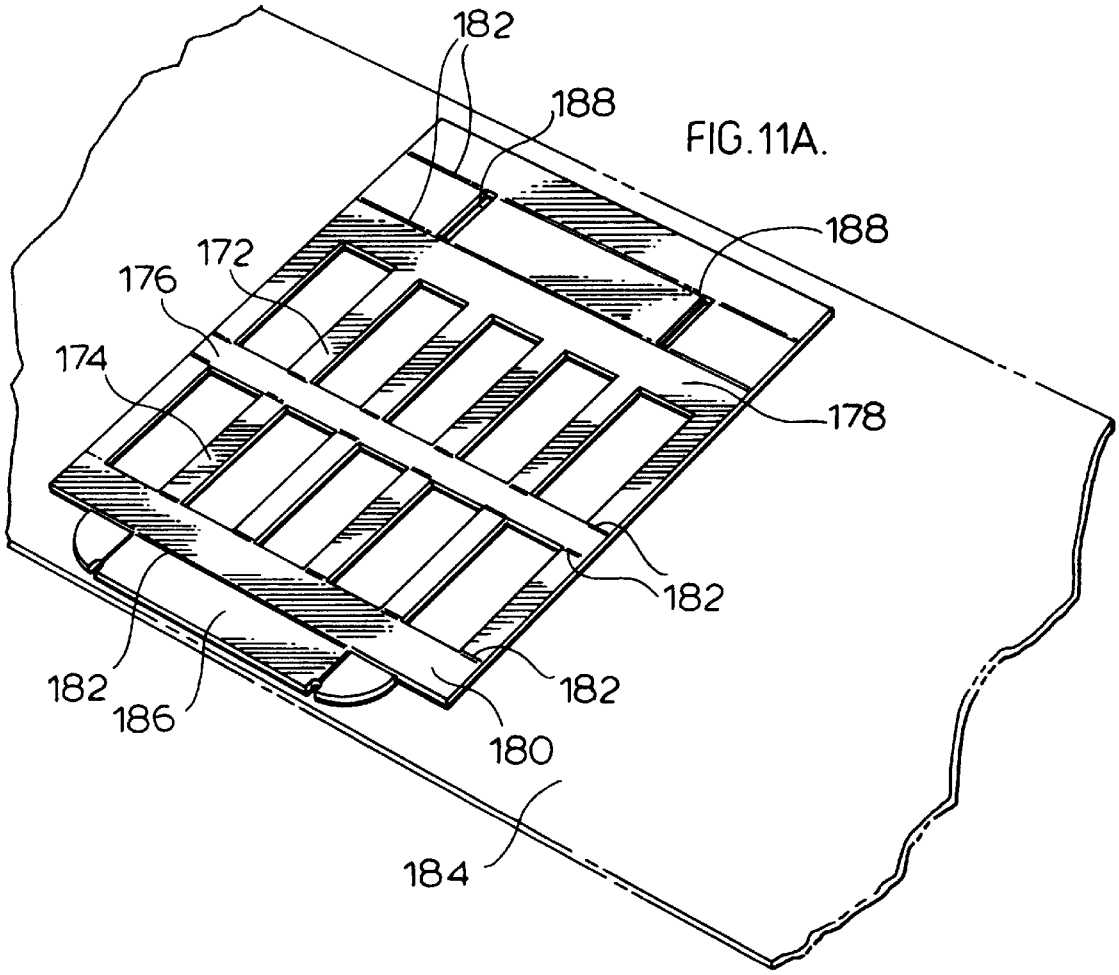

Figures 11A and 11B illustrate a still further alternative form of coin holder 170 not requiring molds for either injection moulding or thermoforming. In this embodiment, coin holder 170 is designed with similar rib structure 172, 174, elongate bar 176 and upper rails 178, 180 to the embodiments described above to secure the coins. Creases 182 are formed by heated pressure wheels on a continuous plastic sheet web 184 of roll stock with in-line diecutting and stripping. Coin filling and clip closing may also be in-line. A diecut locking tab 186 and slots 188 receiving locking tabs therein provide a secure locking means.

GENERAL DESCRIPTION OF INVENTION

In one embodiment of the invention, therefore, the new coin clips comprise a base which may have a slightly thickened section in the shape of a bar to which a series of two opposing spring-loaded arms of the coin holder are attached. This bottom bar serves several functions. The bar provides a level base upon which the clip of coins can rest in upright position (for shipping etc.) and also provides an anti-roll feature, especially helpful when a bank teller is serving a customer on a very narrow "counter". The bar also provides a legal identity panel which informs the customer, retailer etc. of the type, number and value of the coins in each clip size.

In the molding process, this "bar" feature also provides the ideal location for the gate or port through which the molten plastic resin is injected so that it will spread out quickly and efficiently to fill all of the adjoining arms and top rails on each side of the clip mouth where the coins enter. In short, the bottom bar, as described, provides a built-in runner bar for evenly feeding the hot resin quickly to all parts of the clip. This feature results in shorter molding cycles, greater production output as well as decreased costs.

ACCURACY OF COIN COUNT

As mentioned previously, one of the inherent drawbacks with the paper wrapper and thermoformed plastic coin holder is the lack of accuracy of the coin count and the ability for one or two coins more or less than the correct total to exist. This particular problem had been solved by the coin holder structure described in my U.S. Pat. No. 4,715,492. However, this design of coin holder is not suitable for high speed automated machine loading and possesses other drawbacks, as mentioned above.

The new coin holder of the present invention, however, achieves similar results to those obtained with U.S. Pat. No. 4,715,492 in terms of accuracy of coin count through the unique method of using spring loaded arms to secure the coins in position. At the same time, the spring-loaded arms offer a means of separating the coins into groups of five for easy, at-a-glance, counting. This series of tapered arms is joined at the lower end, to the identity bar on the base of the holder. The slender part of these parallel arms are joined to a thickened rail whose upper planar surface is angulated to the centre of the coins, yet parallel to the bottom identity bar on the clip. The angle of the arms on each side of the clip is inclined so that the two upper rails joined to the distal ends of the multiple arms on each side of the clip form jaws which are cammed open as the coins are pressed into the clip. The jaws of the clip (the distance between the parallel rails) is considerably less than the coin diameter. Beginning at one end of the clip, the coins in groups of five may be "plunge fed" into the spring-like jaws of the clip. After the clip is cammed open and the coins are in position, the set of arms spring back close to their original molded position. The grip of the arms on the coin is always under a slight tension, assuming a tight grip on the coins. Each group of four arms, with their upper and lower bar attachment (or "cell" securely encapsulate each group of five coins.

Using this design there is no critical need for a lid portion as in the prior art or any locking means to secure the top and bottom of the clip together to hold the coins in place. With the new design there is a dramatic saving in material content and the spring-like arms of the clip that form the main body of the clip, also serve a dual function as functional dividers that separate the coin into units of five, or other convenient number, to provide accuracy of coin count as well as "at-a-glance" coin-count checking. One missing coin can be detected immediately.

Another object of this invention is to overcome the serious problem in prior art packaging of unreliable coin count when the roll of coin is received by the consumers, bank tellers or cashiers. As already explained in some detail, the unique spacing of the coins into groups of five solves the problem of coin variation so that the coin holder, when filled, provides a perfect count every time. The open nature of the package provides ready visual checking of the coin count so that the recipient, (consumer, teller or cashier), can see immediately if even one coin is missing. In other words, this invention guarantees a perfect coin count every time. Any attempt to short-change the recipient by omitting a coin or two would be immediately detected and prevented.

It will be seen from the above description that one of the major objectives of coin-count accuracy has been accomplished by a simplified design, with less material content, faster manufacturing cycle and lower cost. The new coin clip provided herein guarantees a perfect coin count every time without the need for counting.

AUTOMATION AND HIGH SPEED FILLING

By design, one of the other major objects of this invention is the development of a packaging component which will be part of a complete new system in which automation and high speed filling are key elements. The machine itself is of unique design and geared for very high-speed packaging of coin in a highly functional, more convenient format than ever before. The "V" shaped clip design is the key element in developing the high speed coin loading system. Bundles of five coins can be loaded into the "cells" at considerable rates of speed by plunging groups of five coins into the clip using state of the art servo technology. The coins enter the open part of the "V" and nest in position. The spring action of the plastic "arms" or the folding of the die cut and folded profiles, retain the coins as the process indexes through the series of "cells" until the clip is full.

The plastic holders according to the invention are molded, thermoformed, or die cut and cartridge fed or strip fed into the packaging machine for extremely fast cycle times. The "V" shaped clip provided herein can be manufactured in a number of ways. These include but are not limited to:

1. Injection molding
2. Vacuum forming and die cutting
3. Thermal forming and die cutting
4. Roll forming and die cutting
5. Laminated paper board and die cutting A full clip remains closed using either of two methods. The first method is that the coins are retained by the flexural forces or spring action of the clip arms that are manufactured by methods 1, 2 and 3 mentioned above (see FIGS. 1 to 9). The second method is by means of a locking tab that is cut into the die cut profiles mentioned in methods 4 and 5 (see FIGS. 10 and 11).

Considering many of the above features, it is obvious that many aspects of the invention contribute to automation from the molding stage right through to the shipping, storing, filling and final packaging for shipment to financial institutions. Automation and high speed filling more than compensate for the marginal difference in price in the material cost of paper versus plastic. Without this ability, the invention described herein would not provide a viable product.

METHOD OF COIN CONTAINMENT

The "V" shaped clip arrangement contacts the coin bundles of 5 coins in five positions, at approximately 2, 6, and 10 o'clock positions. In addition, the coins are held laterally in each pocket by the two sets of arms on each side of the pocket. This arrangement facilitates filling of the clips from the open "V" side of the coin holder, and the clip retains the coins by pressure and contact on the five positions. The degree of containment and pressure applied to the coins is adjustable by varying the locations of clip contact on the coins, by varying the angle of divergence of the arm, by altering the thickness or formulation of the plastic material.

STACKABILITY

The "V" shaped design of the coin holders of this invention allows for excellent nesting characteristics which allow the product to be densely packaged. This result is beneficial for economical shipping of the product, and the compact retail space required to display, store, and sell the product. Stackability is also important for the machine functions to feed long cartridges of clips into the grippers and feed mechanism on the filling machine.

Space is at a premium in Banks, Trust companies etc., who move large volumes of coin on a weekly basis. Storage areas, especially in proximity to tellers, is almost non-existent. The stackable design of our coin holder makes it more acceptable for dispensing empty clips to consumers and others who need empty clips for manual packaging of coin.

At the point of manufacture, the stackable nature of the coin clip design is a further design feature in providing the option for entire sheets of clips that exit from the molding machine in one piece and telescope or stack in large piles for storage and shipment to the packaging centre with minimal labour and almost no packaging. Notches at the bottom of each of the supporting arms of the clip prevent the clips from being jammed together in such a way that separation would be a problem.

A further option provides for high speed stacking of individual clips into cartridges for high speed feeding and robotic filling and packaging for the financial community.

In the above manner, thousands of clips can be stored and shipped in very little space. The nesting feature described above also provides for simplified denesting of the "sheets" of clips as they are "magazine fed" onto a conveyor for high speed filling.

There is also a notch on the two ends of the clip at the bases of the two arms adjacent to the identity for that provides a secure recessed space designed for insertion of robotic grippers used in the transfer and handling of the clips during manufacture and loading of the clips.

REUSABLE AND RECYCLABLE

The present invention provides both a reusable and recyclable product, thereby obviating a problem with paper and plastic wrappers and coin pouches. The coin holders can be reused anywhere from 15 to 50 times by retailers, banks and consumers. Any damaged clips can be recycled into new ones or into other useful products after regrinding into small resin pellets. The product thereby is ecologically sound and a boon to the environment.

MINIMAL MATERIAL

To make this product affordable and practical to compete with paper and plastic film, a satisfactory product was required with only a minimum of material content. From the drawings described in detail above, it can be seen that this objective has indeed been fully accomplished. The coin holder provided herein is both viable and affordable.

VISUAL PACKAGE

An additional object is to overcome the disadvantages of opaque prior art packaging and plastic film packaging which defies counting by the user. Our plastic coin holder displays the coins fully in a highly visible manner so that there is no doubt as to the type (or denomination) of the coin or the number of coins in the clip. Any slugs, washers or incorrect coins can be immediately identified. If a nickel, for example, were packaged together with "quarters", this would be seen immediately.

BRIGHT COLOUR CODING

Millions of rolls of coin are wrapped by consumers in paper or film without any distinctive colour identity. An additional advantage and object of this invention is the provision of not only a highly visual package but also colour identified packages. Coin holders intended for different denominations of currency can be differently and distinctly stored. A "red" clip, for example, may always help to identify a roll of pennies, whereas an orange clip may identify a roll of quarters. Furthermore, when the clips are empty, the distinctive colour of each clip may help consumers, bankers etc., to know at a glance which clips are for dimes, which are for nickels, etc. Banks and financial institutions may also stack all the red clips, yellow clips etc, together in an orderly, space saving, convenient fashion.

AUTOMATED OR MANUAL LOADING

An additional object of this invention is not only a coin packaging means that can be automated and filled at extremely high speeds but also the provision of a manually filled coin holder for consumers and smaller businesses.

The speed, accuracy and simplicity of the clip design provided herein also appeal to millions of smaller businesses, such as coin vending machine operators, coin laundries etc.

COMPLETE SYSTEM

A further object of this invention is the provision of a complete system that creates a new cycle of utility and convenience for banking institutions, retailers, vending machine operators as well as many other users, including the average consumer. This invention begins its life cycle in magazine or strip form, the coin holders are fed into the packaging machine and are filled with coins. At this point, they become individual loaded clips ready for packing and distribution to financial institutions.

The coin holders are then circulated out to retail accounts, such as supermarkets, drug chains and many others. At this point, they are discharged into cash registers by flexing open the jaws of inverted coin holders to permit coins to be discharged and the colour coded clips are put in bags and returned to the bank for full clips again.

The empty, colour-coded clips are then recycled by banks out to millions of consumers who have millions of dollars of coinage hoarded in tins, jars, boxes and even barrels in which many have collected for years.

The reason why many people have allowed large sums of coin to mount up is the fact that banks do not accept unpackaged coin. They insist that coins be counted and wrapped. Furthermore, hand counting and wrapping of coin is often put off.

It is no easy job to hand count and wrap thousands of coins in paper wraps or in small plastic bags. The task of wrapping or packaging coin in the coin holder of this invention makes a previously slow, tedious job now quick and easy.

One of the hidden benefits provided by the coin holders herein is that no coin counting (visible prior art methods) is necessary. When the clip is full, the coins are automatically counted correctly every time.

TROUBLE-FREE DISCHARGE OF COIN

Prior art coin packaging methods cause severe problems for financial institutions and more-so with retailers in terms of the wrapping of the coin. The removal of coins from paper wrappers, plastic film wrap etc., provides a nuisance and great frustration to cashiers as they try to open prior art packaging. Some use "peel open" methods to release the coins and the majority use the smash open technique. This consists of hitting the roll of coin against the open drawer of the cash register, to split open the tough paper or plastic film. Sometimes this creates a shower of coin in all directions, besides the cash drawer. It is not uncommon to lose a few coins that roll on the floor under the counter etc.

A major object of the invention is to provide a vast improvement in this area over all prior art. The loaded clip of our design is placed over the desired compartment in the cash drawer and with gentle finger pressure on the two jaws of the inverted clip, the coin in the clip is discharged safely and accurately.

As discussed earlier, at this point no garbage is created. The empty clip makes many more trips to banks and consumers and back again to retail accounts.

END-OF-SHIFT COUNTING

An additional object of the invention is to greatly facilitate end of shift counting of coins in retail establishments. By simply snapping the coins from the cash drawer into empty clips, the cash is both organized and counted, ready for the next shift. This feature is especially helpful in busy food and drug chains.

PROMOTION AND FUND RAISING

For retailers, fast-food chains etc., these easy to use money clips have endless promotional possibilities with both children and adults. A youngster, for example, could bring in a clip loaded with nickels or dimes for a special "meal deal" etc. at a fast food chain. Charitable organizations, service clubs, schools etc. can also use the clip set forth in this invention to raise money for charitable and coummunity causes with the millions of coins that are hoarded in the households of the nation.

SUMMARY OF THE DISCLOSURE

All things considered and having regard to the above discussion, it is considered that this invention provides a significant forward step in providing a complete, new, high-speed automated system for low cost, affordable packaging of coin. Not only does the invention provide packaging but also ease of handling at all levels of distribution. The coin holder of the invention opens a new era of convenience, automatic coin counting, accuracy and security never before possible. The present invention is a significant forward step in being environmentally friendly by eliminating mountains of waste. It will be seen that all shortcomings of prior art coin packaging have been overcome with the coin holder of this invention and the provision of a completely superior total system has been realized. Modifications are possible within the scope of this invention.

What I claim is:

1. A coin holder, comprising:

an elongate bar of generally rectangular cross-section and having longitudinal sides, said elongate bar permitting said coin holder to be supported on a planar surface, and a plurality of pockets open to the exterior of the coin holder and each dimensioned to hold a stack of the same predetermined number of coins to be packaged therein, each of said pockets being defined by pairs of rectilinearly-extending arm elements extending upwardly and outwardly one pair from each longitudinal side of said bar element to terminate at upper parallel elongate rail elements parallel to the bar element, each member of a pair of rectilinearly-extending arm elements defining a longitudinal extremity of said pocket, said arm elements and said upper rail elements being resiliently flexible between a first position wherein the distance between the upper rail elements is less than the diameter of the coins to be packaged therein, thereby restraining coins to be packaged therein from being inserted into or removed from the pockets, and a second position wherein the distance between the upper rail elements opens up to at least the diameter of coins to be packaged therein, thereby permitting coins to be packaged therein to be inserted into or removed from the pockets.

2. The coin holder of claim 1 which is nestably stackable in multiples of said coin holders.

3. The coin holder of claim 1 having a pair of resiliently flexible elements provided one at each end of said coin holder and joining the arm elements adjacent the upper extremities thereof to provide a limitation to the distance said upper rail elements may be flexed apart and to prevent overstressing of the arm elements.

4. The coin holder of claim 1 having a notch at each end thereof to accommodate gripper arms of automatic handling equipment.

5. The coin holder of claim 1 which is formed by injection molding of resiliently-flexible plastic material.

6. The coin holder of claim 1 which is dimensioned so that, when coins are packaged in predetermined numbers in said pockets, said upper rail elements are resiliently flexed away from each other to maintain the coins under tension.

7. The coin holder of claim 1 which is dimensional so that, when coins are packaged in predetermined numbers in the pockets, downward pressure of inserting the coins cams open the upper rail elements, permitting entry of the coins into the pockets and subsequent maintenance of the coins in the pocket under tension.

8. The coin holder of claim 7 wherein said arm element terminates at the upper extremity in a taper in order to provide a directional ramping effect for the coins as they are downwardly inserted and guided into the pockets.

9. The coin holder of claim 1 wherein said elongate bar bears identifying information.

10. A coin holder which is nestably stackable in multiples of said coin holders, comprising:

an elongate bar of generally rectangular cross-section and having longitudinal sides, said elongate bar permitting said coin holder to be supported on a planar surface, and a plurality of pockets each dimensioned to hold a stack of the same predetermined number of coins to be packaged therein, each of said pockets being defined by pairs of vertically-extending arm elements extending upwardly and outwardly one pair from each longitudinal side of said bar element to upper parallel rail members parallel to the bar element, said arm elements and said upper rail elements being resiliently flexible between a first position wherein the distance between the upper rail element is less than the upper rail element is less than the diameter of the coins to be packaged therein, thereby restraining coins to be packaged therein from being inserted into or removed from the pockets, and a second position wherein the distance between the upper rail elements wherein the distance between the upper rail elements opens up to at least the diameter of the coin to be packaged therein, thereby permitting coins to be packaged therein to be inserted into or removed from the pockets, said arm elements being thickened adjacent said elongate bar to define a pair of shoulders, which shoulders provide support for the elongate bar of the next higher number of a stack of said coin holders to prevent jamming of coin holders one inside the other in the stack.

* * * * *